US005805034A

United States Patent [19]

Evans et al.

[11] Patent Number: 5,805,034

[45] **Date of Patent: *Sep. 8, 1998**

[54] MICROSTRIP PATCH FILTERS

[75] Inventors: James G. Evans, Colts Neck; Martin Victor Schneider; Robert W. Wilson, both of Holmdel, all of N.J.

[73] Assignee: Lucent Technologies Inc., Murray Hill, N.J.

[ * ] Notice: The terminal 22 months of this patent has been disclaimed

[21] Appl. No.: 406,289

[22] Filed: Mar. 17, 1995

[51] Int. Cl.[6] ..... H01P 1/20

[52] U.S. Cl. ..... 333/204; 333/202

[58] Field of Search ..... 333/202, 204, 333/205

[56] References Cited

U.S. PATENT DOCUMENTS

| | | | |
|---|---|---|---|
| 2,411,355 | 11/1946 | Rogers | 333/204 |
| 4,233,579 | 11/1980 | Carlson et al. | 333/204 |
| 4,551,696 | 11/1985 | Moutrie et al. | 333/204 |
| 5,136,268 | 8/1992 | Fiedziuszko | 333/204 |
| 5,142,255 | 8/1992 | Chang et al. | 333/204 |
| 5,160,906 | 11/1992 | Siomkos et al. | 333/204 |

FOREIGN PATENT DOCUMENTS

| | | |
|---|---|---|
| 0073653 | 6/1977 | Japan . |
| 0003201 | 1/1985 | Japan . |
| 0019302 | 11/1985 | Japan . |
| 0071702 | 3/1991 | Japan . |
| 4288702 | 10/1992 | Japan . |
| 5211402 | 8/1993 | Japan . |

*Primary Examiner*—Benny Lee
*Assistant Examiner*—Darius Gambino

[57] ABSTRACT

A microstrip patch filter in which a dielectric has a ground plane printed on one of its faces and a conductive arrangement printed on the other of said faces, the conductive arrangement includes a flat patch, input and output leads electromagnetically coupled to the flat patch, the flat patch or the dielectric substrate has a reactance-enhancing metallic constriction located along a portion of the patch. When the constriction is in the patch it forms a current-concentrating inductive constriction. When the constriction is in the dielectric substrate, it enhances the capacitance. In an embodiment, the patch has two mutually-transverse constrictions that divide the patch into four sub-patches cross-connected by current-concentrating inductive constriction.

18 Claims, 3 Drawing Sheets

FI3

MICROSTRIP PATCH FILTERS

RELATED APPLICATIONS

This application is related to our co-pending applications Ser. No. 08/351904 filed Dec. 8, 1994 (Evans 18-24-8), 08/351905 filed Dec. 8, 1994 (Evans 20-26-10) filed Dec. 8, 1994, Ser. No. 08/351912 filed Dec. 8, 1995 (Evans 19-25-9), and assigned to the same assignee as this application.

FIELD OF THE INVENTION

This invention relates to microstrip patch filters, and particularly to methods and means for reducing the size of such filters.

BACKGROUND OF THE INVENTION

Microstrip patch filters are composed of a conductive arrangement and a ground plane printed on or otherwise bonded to opposite faces of a dielectric substrate having a dielectric constant $\epsilon_{r1}$. In a single pole filter, the conductive arrangement includes a single rectangular patch member electromagnetically coupled to a printed or otherwise bonded input lead and a printed or otherwise bonded output lead. The patch member and the ground plane with the dielectric substrate resonate at a wavelength $\lambda_o$ in free space and a wavelength $\lambda$ in the dielectric substrate. Exclusive of fringe effects, $\lambda=\lambda_o/\sqrt{\epsilon_{r1}}$. The dielectric substrate is generally coextensive with the ground plane. The patch member generally has a length $\lambda/2=\lambda_o/2\sqrt{\epsilon_{r1}}$. In multiple pole filters, several such electromagnetically coupled rectangular patch members are printed (or otherwise bonded on the dielectric substrate) between the input and output leads. If the dielectric constant $\epsilon_{r1}=10$, at 2 GHz, ($2\times10^9$ Hertz) $\lambda/2$ is $3\times10^8/(2\times10^9\times2\times\sqrt{10})$ meters or 2.5 cm. Multiple pole filters thus occupy substantial space.

An object of the invention is to reduce the size of such filters.

SUMMARY OF THE INVENTION

According to an aspect of the invention, the dielectric substrate forms one member and the patch forms another member, and such object is attained by forming a reactance-enhancing conductive constriction in one of the dielectric or patch members. The reactance-enhancing constriction increases the inherent distributed inductance or capacitance along the patch and allows for a reduction in the distributed reactance and hence the length of the patch.

According to another aspect of the invention, such object is attained by forming a current concentrating constriction in each patch. The current concentrating constriction forms an inductance which increases the inherent distributed inductance along the patch and allows for a reduction in the distributed capacitance and hence the length of the patch.

According to another aspect of the invention, such object is attained by forming a capacitance-enhancing conductive constriction in the dielectric member at each patch. The added capacitance adds to the inherent distributed capacitance along the patch and allows for a reduction in the distributed capacitance and hence the length of the patch.

These and other features of the invention are pointed out in the claims. Other objects and advantages of the invention will become evident when read in light of the accompanying drawings.

DETAILED DESCRIPTION OF PREFERRED EMBODIMENTS

Figure 1:
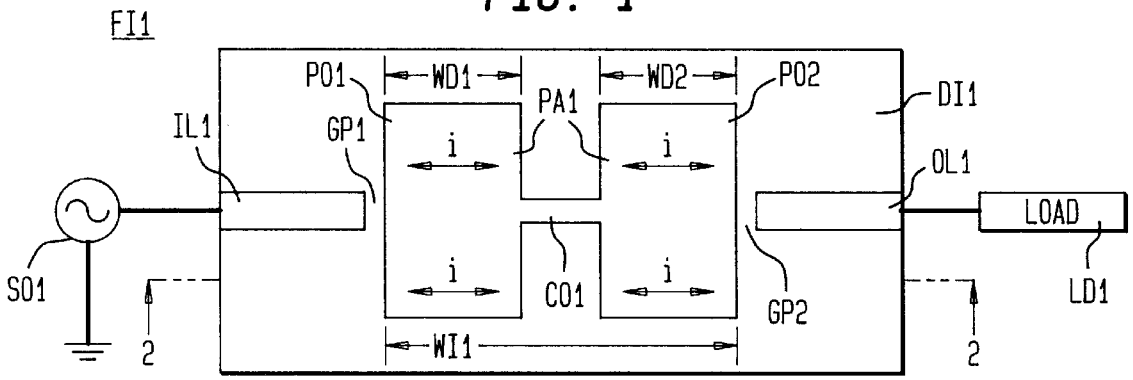
FIG. 1 is a plan view of a microstrip patch filter according one embodiment of the invention.
Figure 2:
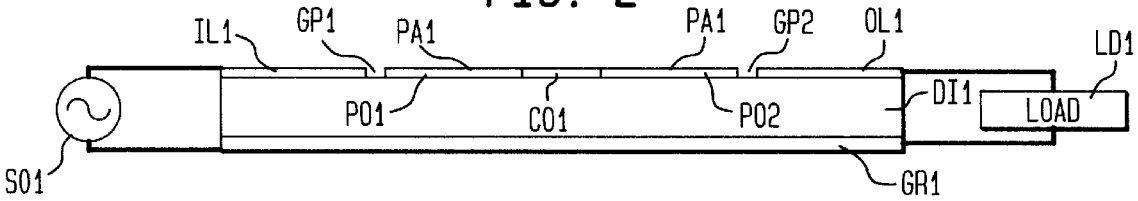
FIG. 2 is a section 2—2 of FIG. 1.

FIGS. 1 and 2 illustrate one embodiment of a microstrip patch filter FI1 according to the invention. Here, a dielectric substrate, or dielectric member, DI1 in the form of a flat plate or sheet has a ground plane GR1 printed over or otherwise bonded to its entire lower face. An input lead IL1 printed on or otherwise bonded to the upper face of the dielectric substrate DI1 is electromagnetically coupled to a rectangular patch (or patch member) PA1 which is also printed on or otherwise bonded to the dielectric substrate DI1. The lead IL1, when energized by a source SO1 across it and the ground place GR1, serves to feed electromagnetic energy in the GHz range to the patch PA1 across a gap GP1. An output lead OL1, electromagnetically coupled to the patch PA1 across a gap GP2, passes electromagnetic energy out from the patch to a load LD1.

A central constriction CO1 divides the patch PA1 into two rectangular portions PO1 and PO2. The patch PA1 has an overall width WI1 and the portions P01 and P02 have respective widths WD1 and WD2. The central constriction C01 and the dimensions of the patch PA1 determine the central frequency and bandwidth of the energy passed by the filter FI1. Examples of the widths WD1 and WD2 are $\lambda/8$ each and example of the gap dimension is $\lambda/20$, where $\lambda$ is the wavelength of the center frequency.

A filter with a patch but without the constriction CO1, namely a filter according to the prior art, passes a band with a central frequency equal to c/(2[WI1]), where c is the speed of propagation of electromagnetic energy in free space. That is the horizontal dimension of the unconstricted patch is $\lambda/2$ where $\lambda=\lambda_o/\sqrt{\lambda_{r1}}$ is the wavelength of the center frequency of the passed band.

The constriction C01 concentrates the currents which the input lead IL1 electro-magnetically induce in the patch PA1 and which flows in the patch PA1. This current concentration produces magnetic fluxes which cause the constriction to behave like an inductance between the portions PO1 and PO2. This inductance raises the total inductance from the distributed inductance in the patch PA1, and allows reduction in the distributed capacitance to obtain the same resonant frequency. Hence, it permits a reduction in the total area and particularly the overall width WI1 of the patch PA1.

In operation, the input lead LD1 passes energy from the source SO1 to the patch PA1 and induces currents which the constriction CO1 concentrates. The patch PA1 behaves as a distributed transmission line and serves as a filter. The constriction injects a high inductance into the transmission line. The inductive effect arises from the concentration of currents which produce fluxes that have a significant inductive effect in the GHz range. The inductance lowers the resonant frequency of the structure. This permits the patch to be made smaller to operate at the same frequency as a patch without the constriction CO1.

Figure 3:
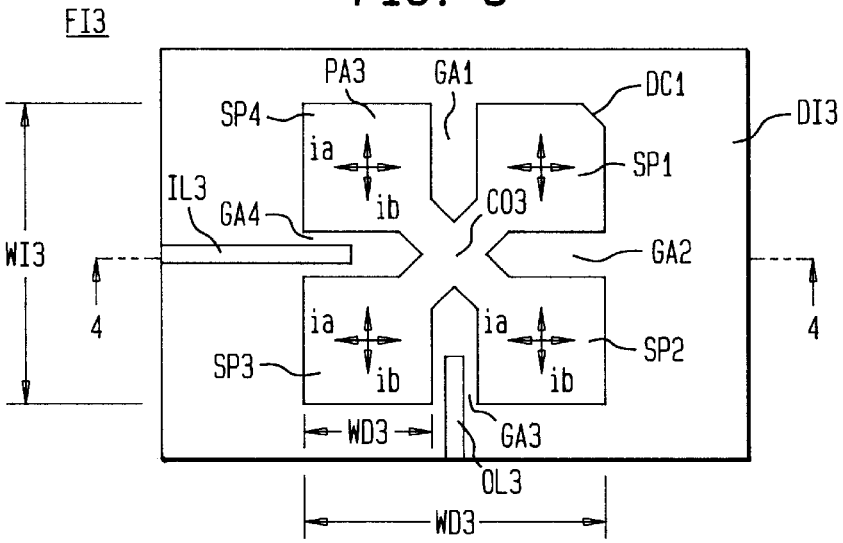
FIG. 3 is a plan view of another embodiment of the invention.
Figure 4:
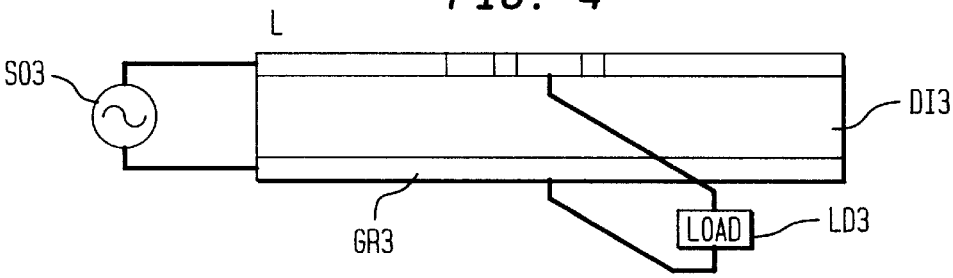
FIG. 4 is a section 3—3 of FIG. 3.

FIGS. 3 and 4 illustrate another embodiment of the invention which produces the effects, such as bandwidth, of a two pole filter and yet maintains the size reduction of the filter in FIGS. 1 and 2. Here, in a filter FI3, a patch PA3 of an overall rectangular shape is printed on or otherwise bonded to the upper face of a dielectric substrate DI3 which carries a printed or otherwise bonded ground plane GR3. Four pencil shaped gaps GA1, GA2, GA3, and GA4 form a cross-shaped constriction CO3 and divide the patch PA3 into four square sub-patches SP1, SP2, SP3, and SP4. The horizontal dimension of the patch PA3 differs from its vertical dimension. The four square sub-patches SP1, SP2, SP3, and SP4 differ from their vertical dimensions, but their horizontal dimensions are all the same, and their vertical dimensions are all the same. A diagonal cut DC1 appears at the corner of the sub-patch SP1.

An input lead IL3 that extends into the gap GA4 is electromagnetically coupled to the patch PA3. When energized by a source SO3 across it and the ground plane GR3, the input lead IL3 serves to induce currents ia and ib in mutually orthogonal modes into the sub-patches SP1 to SP4. The patch and sub-patch dimensions in the direction of the currents ia determine the wavelengths of the currents ia, and the patch and sub-patch dimensions in the direction of the currents ib determine the wavelengths of the currents ib. There are thus two resonances or modes in the patch PA3. The cut DC1 creates a second order disturbance that couples the two modes. This creates a wide bandpass comparable to that of a coupled two pole filter. Hence the patch PA3 operates as if there were a two pole filter within the same space as a single pole filter.

The constriction CO3 has the effect of constricting the currents ia and ib passing between the sub-patches SP1 to SP4 and has some effect in coupling the mutually-orthogonal modes. An output lead OL3 extending into the gap GA3 and electromagnetically coupled to the patch PA3 serves to pass the energy out of the filter FI3 to a load LD3 transverse to the input lead.

The cross-shaped constriction CO3 serves further to reduce the size of the patch. The central constriction CO3 and the dimensions of the patch PA3 determine the central frequency and bandwidth of the energy passed by the filter FI3. An example of the width WI3 of the patch is approximately $\lambda/4$ and an example to the equal widths of the sub-patches SP1 to SP4 is approximately $\lambda/8$. The gap widths are for example $\lambda/40$.

In operation, the input lead IL3 passes energy from the source SO3 to the patch PA3 and induces currents which the constriction CO3 concentrates. The patch PA3 behaves as a distributed transmission line and serves as a filter. The constriction CO3 injects an inductance into the patch transmission line. The inductive effect arises from the concentration of currents which produce fluxes that have a significant inductive effect in the GHz range. The inductance lowers the resonant frequency of the structure. This permits the patch to be made smaller and operate at the same center frequency as a patch without the constriction CO3.

At the same time, the diagonal cut DC1 introduces second order disturbances that couple the two modes that result from the different dimensions in the horizontal and vertical directions (in the plane of FIG. 3). The output lead OL3 is transverse to the input lead IL3 to take advantage of the coupled modes.

Figure 5:
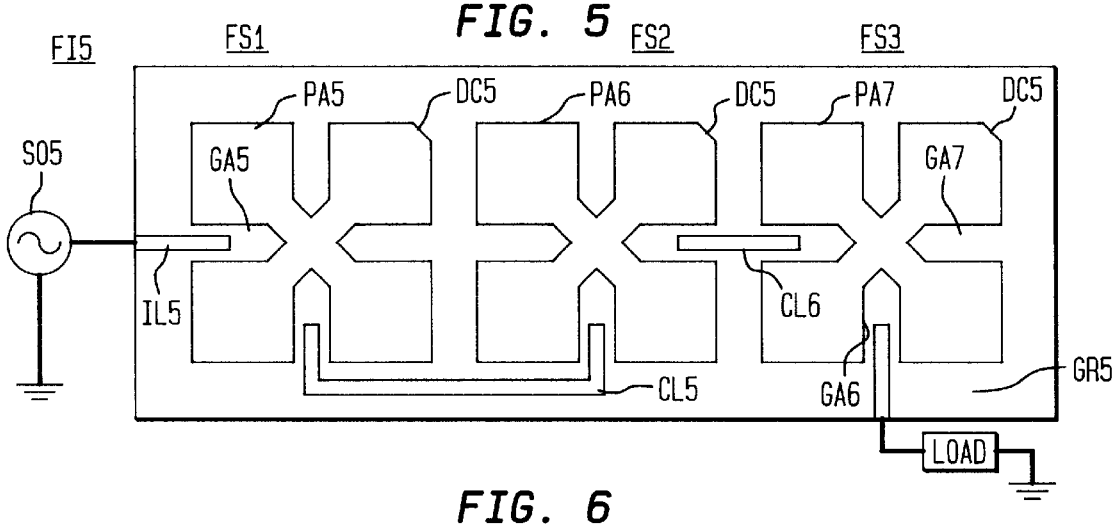
FIG. 5 is a plan view of another embodiment of the invention.
Figure 6:
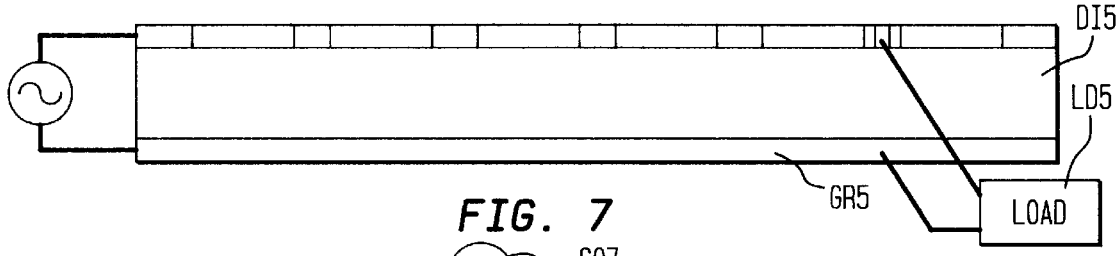
FIG. 6 is an elevation of the embodiment of FIG. 5.

FIGS. 5 and 6 are plan and elevational views of another embodiment of the invention. Here, a multiple pole filter F15 includes three filter sections FS1, FS2, and FS3 with identical mutually and electromagnetically coupled patches PA5, PA6, and PA7. The patches PA5, PA6, and PA7 are each identical to the patch PA3 of FIG. 3 with a diagonal cut DC5. A dielectric substrate DI5 has the patches PA5, PA6, and PA7 and a ground plane GR5 printed thereon or otherwise bonded thereto.

An input lead IL5 that extends into the gap GA5 is electromagnetically coupled to the patch PA5. When energized by a source SO5 across it and the ground plane GR5, the input lead IL5 serves to induce currents in two orthogonal resonant modes in the patch PA5. A coupling lead CL5, transverse to the input lead IL5, transfers energy from the coupled modes in the patch PA5 to a vertical gap (in the plane of FIG. 5) of the patch PA6. A coupling lead CL6 the electromagnetically couples energy to the patch PA7 and an output lead transverse to the coupling lead CL6 transfers energy to the load LD5

In operation, the input lead IL5 passes energy from the source SO5 to the patch PA5 and the latter passes energy to the patch PA6 through the coupling lead CL5. The latter in turn passes energy to the patch PA7 through the coupling lead CL6. The output lead OL5 passes the energy to the load LD5. The device of FIGS. 5 and 6 operates as a six pole filter with three filter sections.

Figure 7:
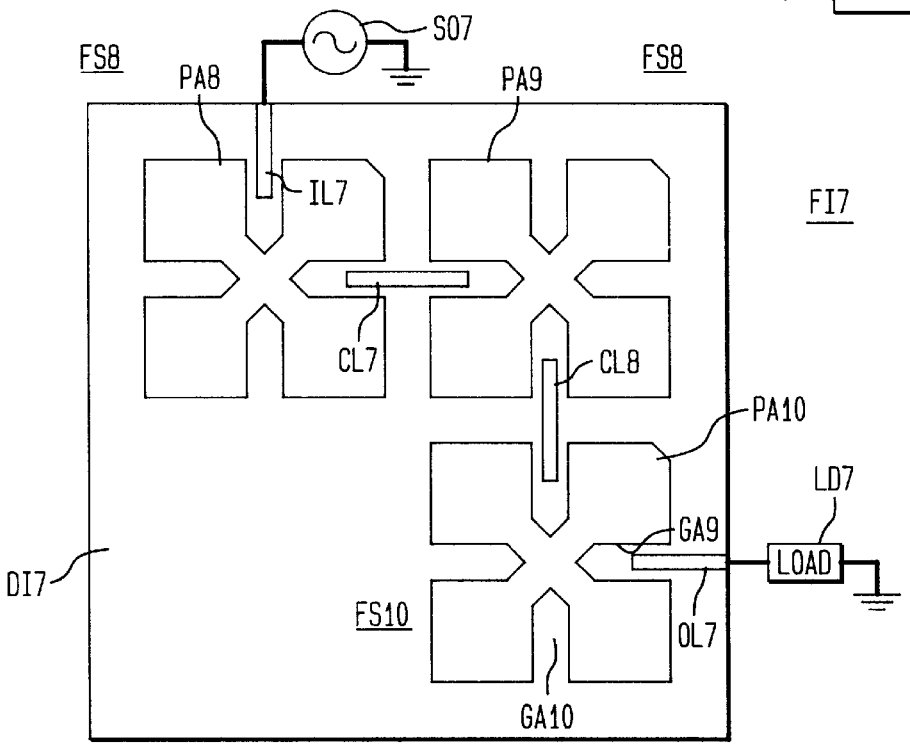
FIG. 7 is a plan view of another embodiment of the invention.
Figure 8:
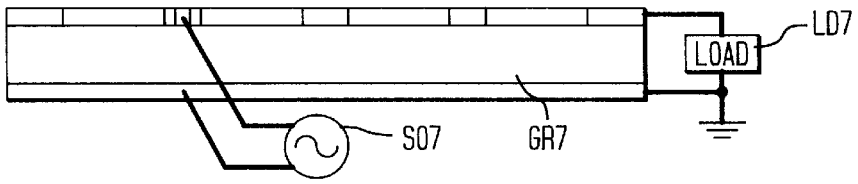
FIG. 8 is an elevation of the embodiment of FIG. 7.

FIGS. 7 and 8 are plan and elevational views of another embodiment of the invention. Here, a multiple pole filter FI7 includes three filter sections FS8, FS9, and FS10 with identical mutually and electromagnetically coupled patches PA8, PA9, and PA10. The patches PA8, PA9, and PA10 are each identical to the patch PA3 of FIG. 3. A dielectric substrate DI7 has the patches PA8, PA9, and PA10 and a ground plane GP7 printed thereon or otherwise bonded thereto.

An input lead IL7 that extends into the gap GA8 is electromagnetically coupled to the patch PA8. When energized by a source SO8 across it and the ground plane GR7, the input lead IL7 serves to induce currents in the patch PA8. A coupling lead CL7 transverse to the input lead IL7 electromagnetically couples the resonant patch PA7 to the patch PA8. A coupling lead CL8 transverse to the coupling lead CL7 electromagnetically couples the resonant patch PA8 to the patch PA9. An output lead OL7 extending into a gap GA10 and electromagnetically coupled to the patch PA10 serves to pass the energy out of the filter FI7 to a load LD7.

In operation, the input lead IL7 passes energy from the source SO7 to the patch PA8 and the latter passes energy to the patch PA9 which in turn passes energy to the patch PA10. The output lead OL7 passes the energy to the load LD7. The device of FIGS. 7 and 8 operates as a six pole filter with three filter sections.

According to other embodiments of the invention, the patches PA5, PA6, and PA7, are not identical but are dimensioned to be slightly detuned from each other to obtain desired bandpasses and to reduces or increase peaks within the bandpass. Similarly, according to other embodiments of the invention, the patches PA8, PA9, and PA10 are not identical but are dimensioned to be slightly detuned from each other to obtain desired bandpasses and to reduces or increase peaks within the bandpass.

According to another embodiment of the invention patches such as PA1, PA3, PA5, PA6, PA7, PA8, PA9, and PA10 have edges extending into constrictions in the dielectric substrates DI1, DI3, DI5, and DI7.

Figure 9:
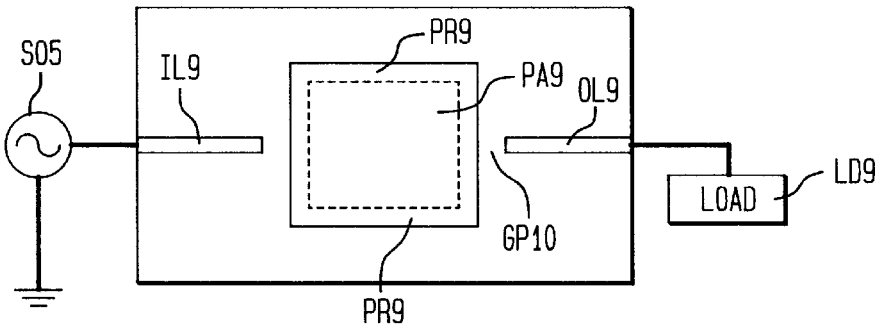
FIG. 9 is a plan view of another embodiment of the invention.
Figure 10:
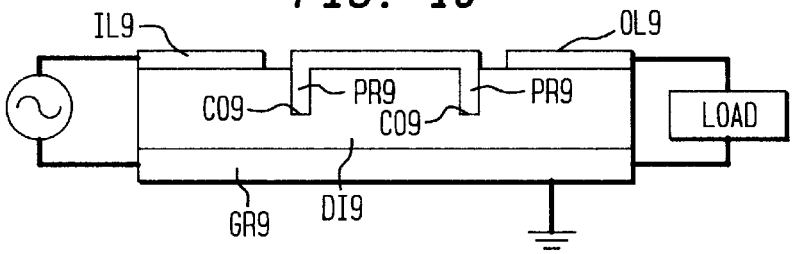
FIG. 10 is an elevation of the embodiment of FIG. 9.

An example showing the such extensions in constrictions appears in the simple rectangular patch of FIGS. 9 and 10. Here, a dielectric substrate DI9 in the form of a flat plate or sheet has a ground plane GR9 printed over or otherwise bonded to its entire lower face. An input lead IL9 printed on the upper face of the dielectric substrate DI9 is electromagnetically coupled to a flat rectangular patch PA9 which is also printed on the dielectric substrate DI9. The lead IL9, when energized by a source SO9 across it and the ground place GR9, serves to feed electromagnetic energy in the GHz range to the patch PA9 across a gap GP9. An output lead OL9, electromagnetically coupled to the patch PA9 across a gap GP10, passes electromagnetic energy out from the patch to a load LD9.

Downward projections PR9 at the edges of the patch PA9 extend into constrictions CO9 in the dielectric substrate DI9 around the entire outer edges ED9 of the patch PA9. The constrictions CO9 are blind slots in the dielectric substrate DI9. The projections PR9 and the constrictions CO9 in the dielectric substrate DI9 increase the edge capacitance of the patch PA9 with the ground plane GR9 and hence add to the distributed capacitance formed by the patch. This allows a smaller patch to be tuned to the same frequency as a larger patch without such projections and constrictions. The projections PR9 and the constrictions CO9 in the dielectric substrate DI9 thus effectively decrease the size of the patch.

The projections have the further advantage of restricting stray radiations. This reduces radiation losses, and thus lowers the insertion losses of the filters. The projections further prevent the resonant frequencies from being determined entirely by the length of the structure. This suppresses transmission of harmonics of the fundamental resonances through the filters.

Figure 11:
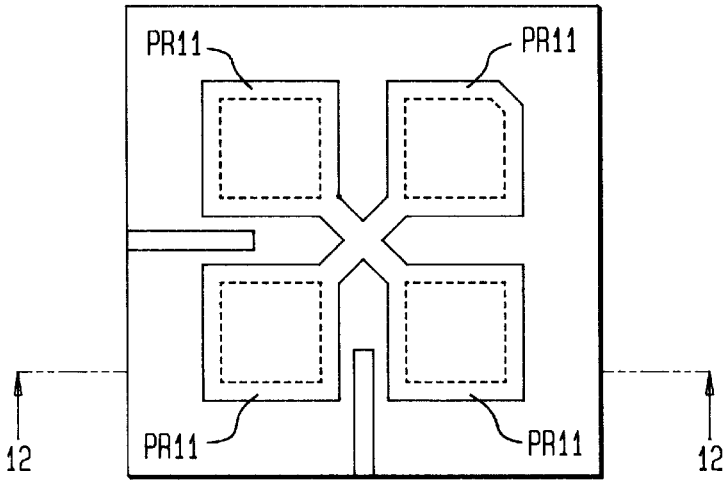
FIG. 11 is a plan view of another embodiment of the invention.
Figure 12:
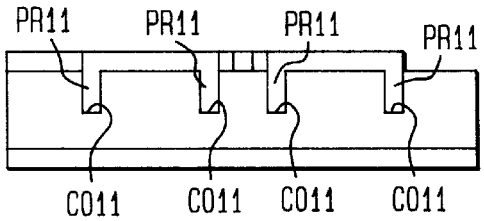
FIG. 12 is an elevation of the embodiment of FIG. 11.

FIGS. 11 and 12 show the structure of FIGS. 3 and 4 with projections PR11 in constrictions CO11.

While embodiments of the invention have been described in detail, it will be recognized that the invention may be embodied otherwise without departing from its spirit and scope.

What is claimed is:

1. A microstrip patch filter, comprising:

a dielectric member having two faces;

a ground plane bonded to one of said faces;

a conductive arrangement on the other of said faces;

said conductive arrangement including:

a patch member;

an input lead electromagnetically coupled to said patch member;

an output lead electromagnetically coupled to said patch member;

said patch member having a first reactance-enhancing conductive constriction forming a gap along a first direction of the patch members said patch member having a second reactance-enhancing conductive constriction forming a gap along a second direction intersecting said first direction.

2. A filter as in claim 1, wherein said first and second constrictions each form current concentrating constrictions.

3. A filter as in claim 1, wherein said first constriction forms two gaps along the first direction and said second constriction forms two gaps along the second direction.

4. A filter as in claim 2, wherein said first current concentrating constriction forms two gaps along the first direction and said second constriction forms two gaps along the second direction.

5. A filter as in claim 2, wherein said first current concentrating constriction forms two gaps along the first direction and said second constriction forms two gaps along the second direction to divide said patch member into four sections.

6. A filter as in claim 5, wherein said first constriction and said second constriction form an x connection across the four sections.

7. A filter as in claim 5, wherein said constriction forms an x connection across the four sections and said sections are substantially rectangular.

8. A filter as in claim 1, wherein said patch member is rectangular.

9. A filter as in claim 1, wherein said arrangement includes a second patch member electromagnetically coupled to said first patch member between said first patch member and said output lead.

10. A filter as in claim 9, wherein said second patch member is substantially identical to said first patch member.

11. A filter as in claim 6, wherein said arrangement includes a second patch member electromagnetically coupled to said first patch member between said first patch member and said output lead.

12. A filter as in claim 11, wherein said second patch member is substantially identical to said first patch member.

13. A filter as in claim 1, wherein said input lead extends into said first gap and said output lead extends into said second gap.

14. A filter as in claim 1, wherein said second gap is transverse to said first gap, and said input lead extends into said first gap and said output lead extends into said second gap transverse to said first gap.

15. A filter as in claim 1, wherein said conductive arrangement and said dielectric member and said ground plane form a filter having a center wavelength $\lambda_o$ in free space and a wavelength $\lambda$ in the dielectric member where $\lambda=\lambda_o/\sqrt{\epsilon_{r1}}$ and the dielectric member has a dielectric constant $\epsilon_{r1}$;

said constrictions forming gaps such that the patch has maximum dimensions substantially less than $\lambda/2$.

16. A filter as in claim 15, wherein said patch has a maximum dimension substantially equal to $\lambda/4$.

17. A filter as in claim 16, wherein each of said four sections has a dimension substantially equal to $\lambda/4$ and each of said constrictions forms a gap substantially equal to $\lambda/20$.

18. A filter as in claim 1, wherein said second gap is transverse to said first gap.

* * * * *